United States Patent [19]

Shiley

[11] Patent Number: 4,998,892

[45] Date of Patent: Mar. 12, 1991

[54] GUIDE PIN APPARATUS FOR MODULE CONNECTOR

[75] Inventor: Robert J. Shiley, Riverside, Calif.

[73] Assignee: ITT Corporation, New York, N.Y.

[21] Appl. No.: 491,777

[22] Filed: Mar. 12, 1990

[51] Int. Cl.[5] ..... H01R 13/629

[52] U.S. Cl. ..... 439/381; 439/378

[58] Field of Search ..... 439/378–381, 439/101, 103, 92, 78, 80, 82, 856, 857

[56] References Cited

U.S. PATENT DOCUMENTS

| | | | |
|---|---|---|---|
| Re. 32,502 | 9/1987 | Kumar | 439/92 |
| 4,506,937 | 3/1985 | Cosmos et al. | 339/14 |
| 4,666,222 | 5/1987 | Gallusser et al. | 339/14 |
| 4,679,883 | 7/1987 | Assini et al. | 439/607 |
| 4,690,479 | 9/1987 | Hollyday et al. | 439/97 |
| 4,718,854 | 1/1988 | Capp et al. | 439/63 |
| 4,752,250 | 6/1988 | Seidler | 439/82 |
| 4,776,811 | 10/1988 | Humphrey | 439/378 |
| 4,808,118 | 2/1989 | Wilson et al. | 439/95 |
| 4,842,529 | 6/1989 | Frantz et al. | 439/95 |
| 4,842,543 | 6/1989 | Davis | 439/378 |

FOREIGN PATENT DOCUMENTS

| | | | |
|---|---|---|---|
| 238801 | 7/1987 | European Pat. Off. | 439/378 |
| 024172 | 2/1958 | Fed. Rep. of Germany | 439/101 |
| 2512283 | 3/1982 | France | 439/924 |
| 114985 | 5/1926 | Switzerland | 439/857 |

OTHER PUBLICATIONS

"Dual-Level Printed Circuit Board Edge Connector", Research Disclosure, Aug. 1987, No. 280.

*Primary Examiner*—Gary F. Paumen

*Attorney, Agent, or Firm*—Thomas L. Peterson

[57] ABSTRACT

A connection system is provided of the type wherein a plug connector must be accurately guided to mate with a receptable connector, which minimizes the space coupled by guiding apparatus and which enables the guiding apparatus to electrically ground portions of the two connectors. The plug connector (12, FIG. 4) includes an insulative body (40) with small holes that hold signal contacts (24), the body also having larger holes (42) that hold guide pins (30) that project rearwardly further than the signal contacts to guide the connectors so they properly mate. The receptable connector (14, FIG. 5) has larger socket contacts (60) with through holes therein, which initially receive rearward guide parts (56) of the guide pins to provide the guiding function, and which then receive greater diameter contacting parts (58) of the guide pins which make good electrical contact with the socket contacts. Each guide pin has a forward contacting end (82, FIG. 4) which has resilient fingers to project through a plated hole (84) of a printed circuit board, the forward end having a taper that retains the guide pin in the circuit board.

3 Claims, 3 Drawing Sheets

FIG. 1
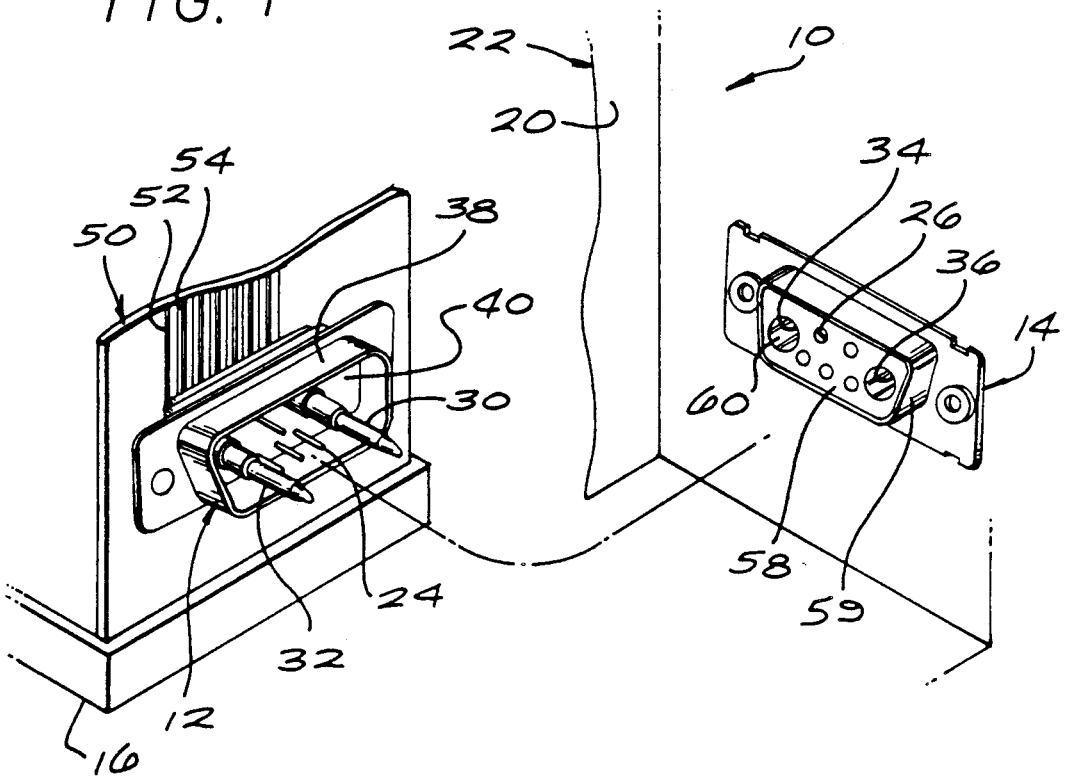
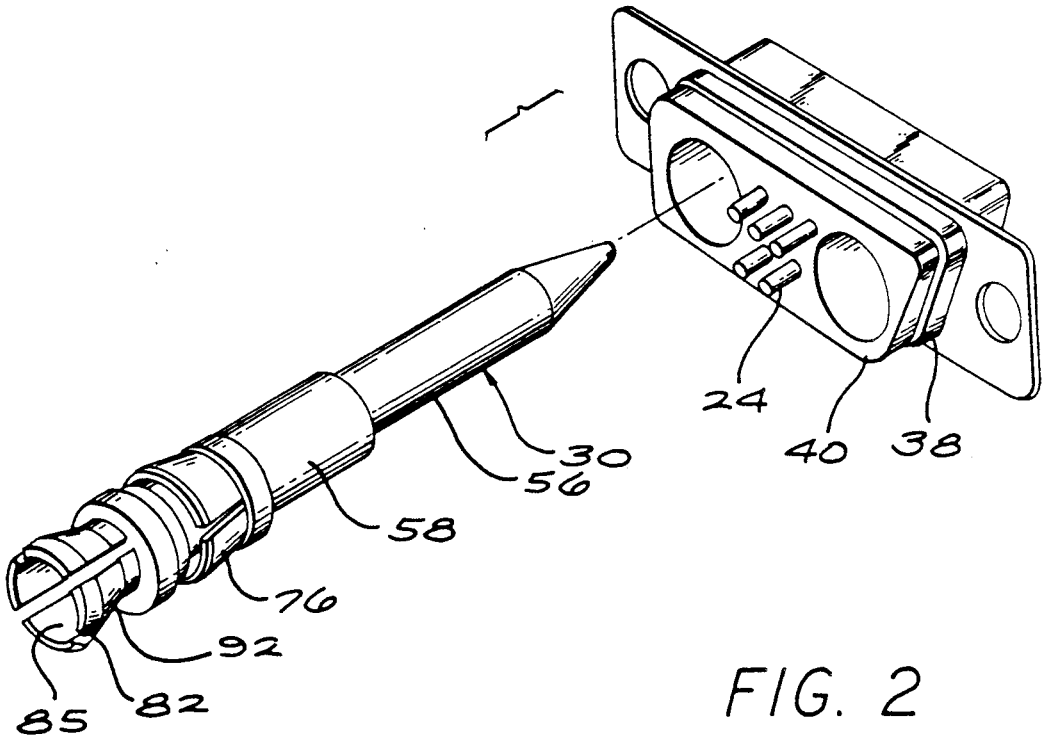
FIG. 2

FIG. 5
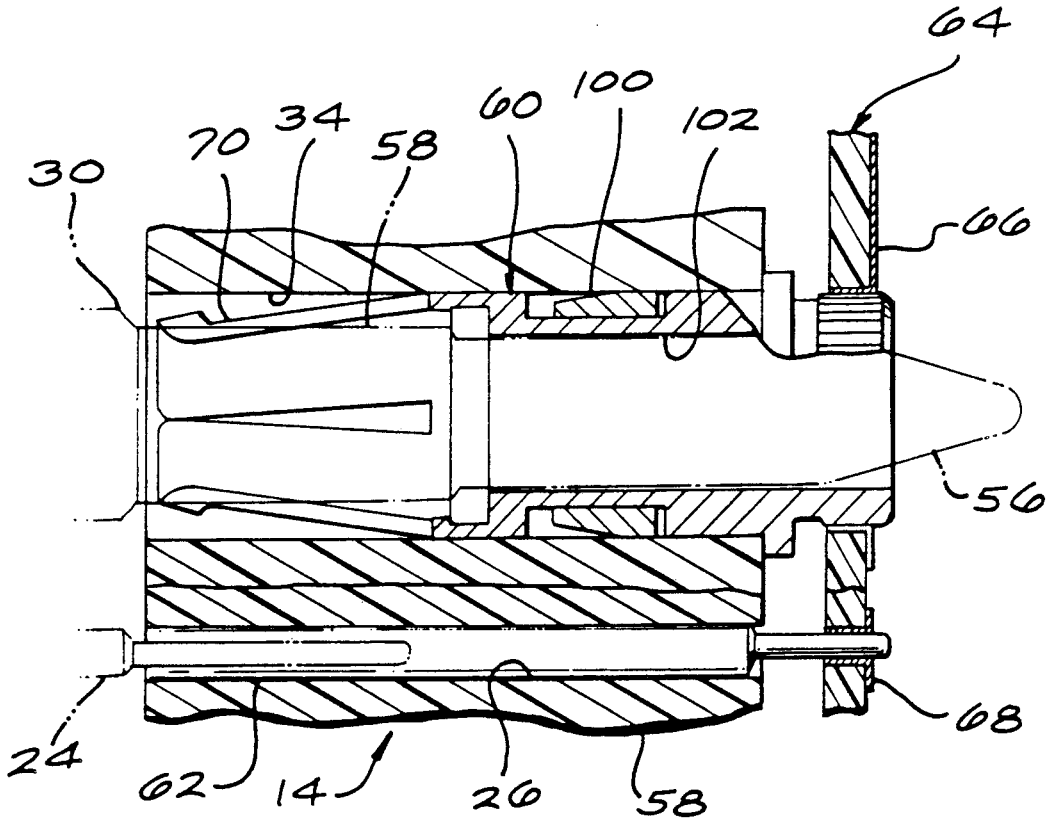
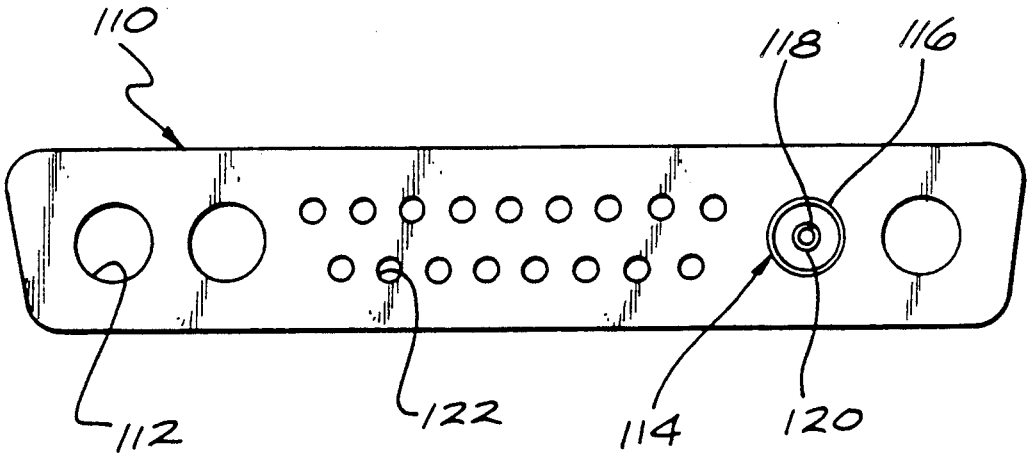
FIG. 6

GUIDE PIN APPARATUS FOR MODULE CONNECTOR

BACKGROUND OF THE INVENTION

Plug and receptacle connectors must often be mated in a blind space, such as where a plug-in module has a plug connector at its rear. When the module is inserted rearwardly into a deep slot in a frame, the plug connector at the rear of the module must mate with a receptacle connector on the frame at the rear of the slot thereof. The most common practice is to provide a separate guide plate with rearwardly-projecting pins that assure accurate alignment of the connectors as they approach each other. However, the guide plate takes up additional room around the plug connector and constitutes an added expense. It may be noted that connectors commonly used include an insulative body with small holes for holding ordinary signal contacts and larger holes for holding coaxial contacts. A connection system which provided guide pins for accurately aligning a pair of connectors as they approached one another to mate, which avoided the need for extra space around the connectors to accommodate such guide pins, which used such guide pins to connect the ground planes of the circuitry coupled to the two connectors, and which enabled such guiding function to be easily added to existing connector designs, would be of considerable value.

SUMMARY OF THE INVENTION

In accordance with one embodiment of the present invention, a connection system is provided of the type that includes a plug connector which must be guided to mate with a receptacle connector, which assures precision guiding in a compact arrangement. Each connector is of the type that includes an insulative body with holes that hold contacts. A pair of guide pins are mounted in two of the holes of the plug connector insulative body, the guide pins having rear portions projecting rearwardly from the insulative body. The receptacle connector also has holes holding socket contacts positioned to receive the rear portions of the guide pins and resiliently tightly engage them. The plug connector is mounted on circuitry with a conductor at ground potential, and the guide pin is electrically conductive and is connected to the grounded conductor. Thus, in addition to guiding the connectors into engagement, the guide pin provides an electrical ground connection between the connectors. The rearward portion of the guide pin can include a rearward guide part of smaller diameter that serves solely to guide, and an enlarged contacting part that serves to make a secure ground connection with the socket contact.

The guide pin can be constructed with a compliant forward end for press fit into a plated hole in a circuit board. The guide pin forward end forms a plurality of fingers for engaging the plated hole, where the plated hole is at ground potential. The fingers are long enough to project entirely through the circuit board, and have tapered forward ends that retain themselves to the circuit board.

The novel features of the invention are set forth with particularity in the appended claims. The invention will be best understood from the following description when read in conjunction with the accompanying drawings.

BRIEF DESCRIPTION OF THE DRAWINGS

FIG. 1 is partial isometric view of a connector system of the present invention, showing the plug and receptacle connectors away from each other and mounted respectively on a plug-in module and on a module-receiving frame.

FIG. 2 is a partial exploded view of the plug connector of FIG. 1.

FIG. 5 is a partial sectional view of the receptacle connector of FIG. 1, showing portions that mate with the pin and contact of FIG. 4.

FIG. 6 is a front elevation view of an insulative body constructed in accordance with another embodiment of the invention, and showing a coaxial connector in place.

DESCRIPTION OF THE PREFERRED EMBODIMENTS

Figure 3:
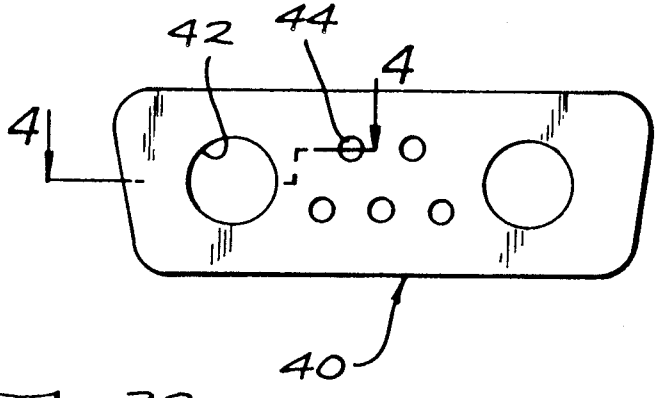
FIG. 3 is a front elevation view of the insulative body of the plug connector of FIG. 1.

FIG. 1 illustrates a connection system 10 wherein a plug connector 12 must mate with a receptacle connector 14. The plug connector lies at the rear of a plug-in module 16, while the receptacle connector lies at the rear of a module-receiving slot 20 of a frame 22. The particular plug connector 12 includes a group of small diameter signal contacts 24 which mate with corresponding receptacle connector signal contacts 26. The connection of the contacts occurs in a hidden space at the rear of the slot 20, and provision must be made for accurately guiding the two connectors as they approach one another to assure that the signal contacts 24, 26 will accurately mate. Applicant provides guide pins 30, 32 that enter holes 34, 36 in the receptacle connector, to provide the guiding function. The guide pins 30, 32 lie in an insulative body 40 surrounded by a metal shell 38 that is mounted on the module. The receptacle body also has an insulative body 58 surrounded by a metal shell 59 mounted on the frame.

Figure 4:
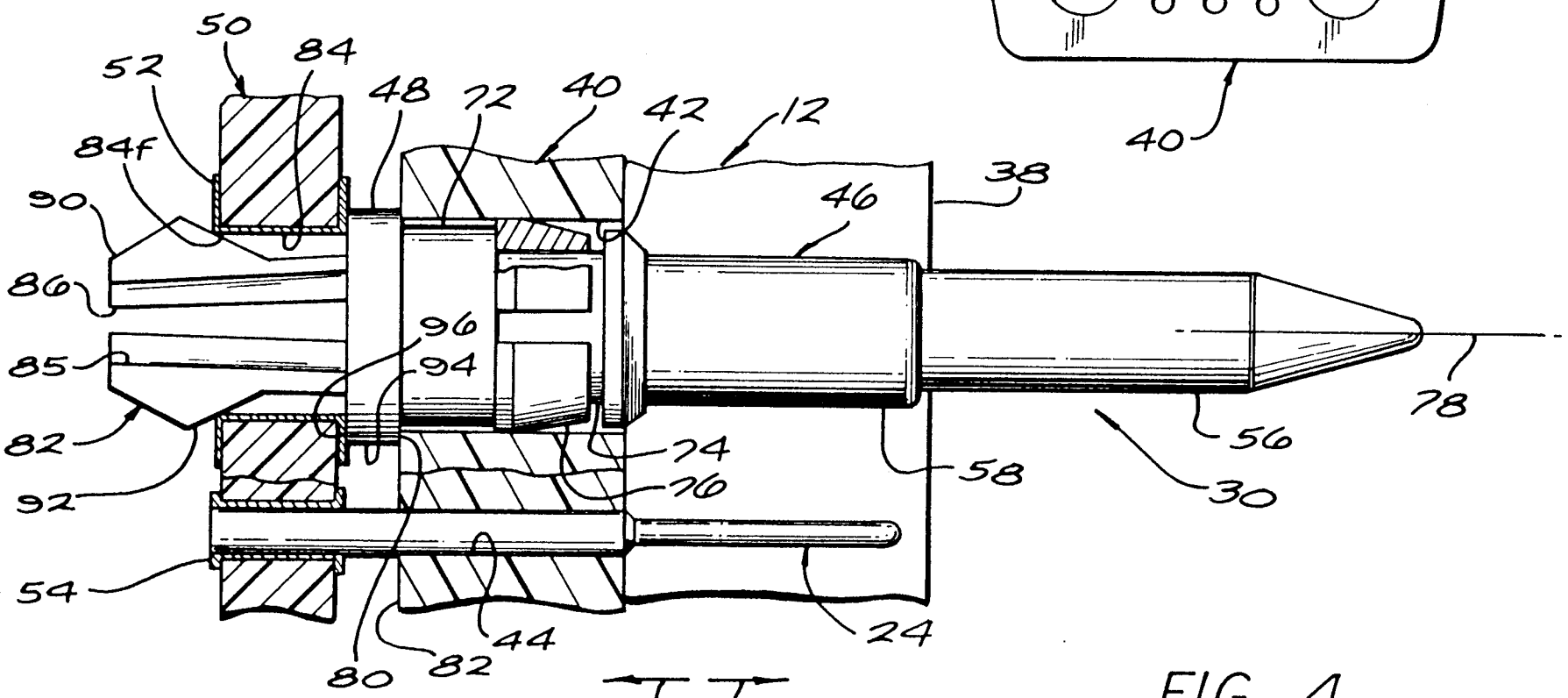
FIG. 4 is a view taken on the line 4—4 of FIG. 3, but with a guide pin and signal contact in the insulative body.

As shown in FIG. 4, the plug connector 12 includes an insulative body 40 with larger holes 42 for holding the guide pins such as 30, and with smaller holes 44 for holding the signal contacts 24. The guide pin 30 includes a rearward portion 46 projecting rearwardly, in the direction of arrow R from the insulative body 40, and includes a forward portion 48 with a part lying in the larger hole 42 and with a part projecting forwardly of the insulative body in the direction of arrow F. The part that projects forwardly of the insulative body 40 connects to conductors on a printed circuit board 50 of the module. These conductors includes an electrical ground portion 52 that is grounded (at least after connections are made) and which is connected to the guide pin 30, and a signal conductor 54 which is connected to the signal contact 24. The rearward portion 46 of the guide pin includes a guide part 56 whose function is to guide the connectors into alignment as they closely approach one another to mate, and a contacting part 58 of slightly greater diameter which is used to make a ground connection between the two connectors.

FIG. 5 illustrates some details of the receptacle connector 14 which includes an insulative body 58 with larger holes such as 34 for receiving the guide pins such as 30 and smaller holes 26 for receiving the signal contacts 24. The receptacle connector includes a socket contact in each hole, including a larger socket contact 60 in a larger hole 34, and a smaller signal contact 62 in a smaller hole 26. The socket contacts of the receptacle connector 14 contact conductors of a flexible circuit board 64 on the frame 22, which includes an electrically grounded conductor 66 connected to the larger socket contact 60, and a signal contact 68 connected to the smaller signal contact 62.

As the plug and receptacle contacts approach one another, the guiding part 56 of the guide pin 30 first enters the larger socket contact 60 to assure accurate guiding of the connectors. The guiding part 56 of each guide pin projects far rearward of the plug connector shell 38. Further rearward movement of the plug connector results in the larger diameter contacting part 58 of the guide pin entering the larger socket contact 60. The socket contact 60 has resilient socket fingers 70 that press firmly against the contacting part 58 of the guide pin to insure good connection therewith. The firm engagement of the socket contact fingers 70 with the contacting part 58 of the guide pin also resists sideward movement of the plug connector which could damage the small diameter signal contacts 24. Thus, the guide pin not only guides or aligns the two connectors as they approach one another, but also serves as an electrical contact that makes a good ground connection between the connectors. The two guide pins 30, 32 lie in holes at opposite sides of the middle of the insulative body, with signal contacts between the guide pins.

As the contacting part 58 of the guide pin moves into the larger socket contact 60, the signal contacts 24 move into the socket signal contacts 62 of the receptacle connector.

As shown in FIG. 4, the forward portion 48 of the guide pin 30 has a mounting part 72 that mounts within a larger hole 42 of the insulative body 40. The mounting part 72 of the guide pin has a recess 74 that holds a retaining ring 76. The guide pin is installed in the insulative body 40 by projecting the guide pin along the axis 78 in the rearward direction R through holes 42 until a shoulder 80 on the guide pin abuts a forward surface 82 on the insulative body. A forward edge of the retaining ring 76 then resists forward movement of the guide pin out of the insulative body.

The forward part of the guide pin includes a forward contacting end 82 that serves to contact the electrical ground conductor 52 of the printed circuit board 50. The ground conductor 52 includes a plated hole 84. The contacting end 82 has a central hole 85 and slots 86 that divide it into resilient fingers 90. As the contacting end 82 is pushed in a forward direction F through the plated hole 84 in the circuit board, the fingers 86 press against the plated hole to maintain electrical contact with it. The contacting end 82 has a tapered region 92, which is tapered to be of progressively smaller diameter at progressively more rearward locations, and which lies in a position wherein it can pass through the plated hole and press against the forward side 84*f* of the plated hole 84, to keep the contacting end 82 in firm engagement with the circuit board and resist removal of the plug connector from the circuit board. The forward portion 48 of the guide pin has an enlargement 94 that forms a forwardly-facing shoulder 96 that abuts the rear face of the circuit board 50.

As shown in FIG. 5, the larger socket contact 60 is held in a larger hole 34 by a retaining ring 100 similar to the retaining ring 76 of FIG. 4. The socket contact 60 has a rearward hole portion 102 that closely receives the guide part 56 of the guide pin to help align the connectors as they approach each other, although the walls of the hole portion 102 do not resiliently engage the guide pin.

It would be possible to mold the guide pin in the insulative body instead of retaining it with a retaining ring 76. However, the ability to install the guide pins after the insulative body is formed, allows positioning of guide pins as the customer selects. FIG. 6 illustrates an insulative body 110 for a plug connector which is one of a variety of such bodies that are available for connectors. In the prior art, the larger holes such as 112 were used to hold coaxial contact assemblies 114 that each include an outer contact 116, an inner contact 118 with a central hole, and an insulator 120 between the contacts. Some or all of the larger holes 112 for holding coaxial contact assemblies, and of the smaller holes 122 for holding simple signal contacts, might be used in any particular application. Applicant uses two of the larger holes 112 that can be used for coaxial contact assemblies, to instead hold a guide and grounding pin 30. Those holes 112 not used for the guiding pin, can be used to hold coaxial contact assemblies. Thus, existing connector designs can be used without a guide plate, by using a pair of larger holes, originally provided for coaxial contact assemblies, to hold guide pins.

Thus, the invention provides a connection assembly with guide pins that align plug and receptacle connectors as they approach one another, which occupies a minimum of additional space. The guide pins mount in the plug connector, while the receptacle connector includes large socket contacts which closely receive the guide pins. Both the socket contacts and guide pins may be constructed of electrically conductive material and serve to connect ground potential conductors to each other. The guide pin can have a narrower rearward guiding part which serves a guiding function, and an increased diameter contacting part which firmly engages the socket contact to establish good electrical connection between them. A front portion of the guide pin can be constructed to have resilient fingers that enter a plated hole of a printed circuit board, with the guide pin front portion being tapered so after the fingers are pressed into the circuit board the tapering holds the guide pin securely to the circuit board.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. In a module connection system wherein a plug connector at the rear of a module mates with a receptacle connector mounted on a frame, wherein the plug connector includes a body of insulative material having a plurality of small signal contact-receiving holes holding signal contacts and a plurality of larger contact-receiving holes, and wherein the plug connector also includes a shell extending around and rearward of said body, and the receptacle connector includes an insulative body having corresponding small holes holding signal contacts and a plurality of corresponding larger holes, the improvement including:

a pair of guide pins, each having a forward portion retained in one of said larger holes of said plug connector insulative body, and each having a rear portion projecting rearwardly from said insulative body further than said shell;

a pair of larger socket contacts each mounted in one of said larger holes of said receptacle connector insulative body and constructed to closely receive said rearward portions of said pair of guide pins;

each of said guide pins has a narrower rearward guide part and a greater diameter more forward contacting part;

each of said larger socket contacts has a plurality of resilient fingers that tightly engage said greater diameter contacting part of a fully inserted guide pin, and a more rearward hole that receives said narrower guide part of the guide pin.

2. In a module connection system wherein a plug connector at the rear of a module mates with a receptacle connector mounted on a frame, wherein the plug connector includes a body of insulative material having a plurality of small signal contact-receiving holes holding signal contacts and a plurality of larger contact-receiving holes, and wherein the plug connector also includes a shell extending around and rearward of said body, and the receptacle connector includes an insulative body having corresponding small holes holding signal contacts and a plurality of corresponding larger holes, the improvement including:

a pair of guide pins, each having a forward portion retained in one of said larger holes of said plug connector insulative body, and each having a rear portion projecting rearwardly from said insulative body further than said shell;

a pair of larger socket contacts each mounted in one of said larger holes of said receptacle connector insulative body and constructed to closely receive said rearward portions of said pair of guide pins;

each of said socket contacts has a hole and slots forming a plurality of resilient fingers;

the forward portion of each of said guide pins has a guide part which passes through a respective said socket hole, and has a larger diameter contacting part which lies forward of said guide part and which is tightly held by said fingers of said first socket contact.

3. A connector system comprising:

mateable plug and receptacle connectors, said plug connector lying forward of said receptacle connector, each of said connectors having an insulative body and a plurality of signal contacts in the body which are mateable with the signal contacts of the other connector;

said receptacle connector having a plurality of holes, and a plurality of electrically conductive socket contacts that each lie in one of said holes;

a plurality of electrically conductive guide pins that each have a forward portion fixed in place in said plug connector body and a rearward portion projecting from said plug connector body by more than said signal contacts of said plug connector, said guide pins projecting sufficiently rearward to enter said socket contacts and align said insulative bodies and said signal contacts prior to mating of said signal contacts, to assure positioning of said connectors so said signal contacts will mate, and to electrically connect at least one of said guide pins to one of said socket contacts;

each of said socket contacts has a plurality of resilient contact fingers;

the rearward portion of each guide pin includes a contacting part of a diameter to be firmly contacted by said fingers of said socket contact, and each guide pin also includes a smaller diameter largely cylindrical guide part extending rearward of said contacting part;

each of said socket contacts has a rearward hole portion with rigid walls, lying rearward of said fingers, which closely receives the smaller diameter guide part of one of said guide pins.

* * * * *